United States Patent [19]

Fridhandler

[11] 4,416,922

[45] Nov. 22, 1983

[54] APPARATUS AND METHOD FOR METERING A COATING APPLIED TO A MOVING WEB

[75] Inventor: Robert M. Fridhandler, Blauvelt, N.Y.

[73] Assignee: St. Regis Paper Company, West Nyack, N.Y.

[21] Appl. No.: 423,463

[22] Filed: Sep. 24, 1982

[51] Int. Cl.[3] ..... B05C 11/02

[52] U.S. Cl. ..... 427/361; 118/119; 427/359

[58] Field of Search ..... 118/118, 119, 126, 246; 427/359, 361, 364

[56] References Cited

U.S. PATENT DOCUMENTS

| | | | |
|---|---|---|---|
| 2,861,541 | 11/1958 | Hornbostel | 118/119 |
| 3,450,098 | 6/1969 | Williams, Jr. | 118/126 |
| 4,331,713 | 5/1982 | Girard et al. | 118/126 X |

*Primary Examiner*—John P. McIntosh
*Attorney, Agent, or Firm*—Joseph M. Maguire

[57] ABSTRACT

A method and apparatus are provided for metering and smoothing coating on a moving web of material, such as linerboard, paperboard, paper, film, foil or the like, in which the web is fed between a skimming rod below the coated side of the web and a skirt of flexible plastic sheet material extending across the full width of the upper or uncoated side of the web and having a free end portion extending in contact with and in the direction of movement of the web. A pressurized tube in contact with the free end portion of the skirt, causes the skirt to bear directly on the upper surface of the web and downwardly on the rod to create a constant pressure web coating region between the web and the rod within which the coating thickness is skimmed down by the rod to provide a layer of coating on the web of substantially uniform thickness.

7 Claims, 2 Drawing Figures

APPARATUS AND METHOD FOR METERING A COATING APPLIED TO A MOVING WEB

BACKGROUND OF THE INVENTION

This invention relates generally to apparatus for and a method of metering the application of coating material to a moving web, and more particularly, to a device for and a method of controlling and assuring that a uniform thickness of a coating composition is applied on the coated side of a moving web of material, such as linerboard, paperboard, paper, film, foil or the like, by a rod coater.

Numerous devices exist for metering excess applied coating on a moving web into a smooth thin layer. These include doctor blades for scraping the excess coating material from the web, and rods, which attempt to uniformly contact the excess coated web across its width to strike off any excess coating from the web. Examples of rod metering devices are shown in U.S. Pat. Nos. 2,229,620 and 2,774,329, while doctor or scraper blades are illustrated in U.S. Pat. Nos. 2,729,192 and 3,113,890.

In rod metering devices, the web can simply be run horizontally across the rod in tangential relation thereto or can be wrapped around spaced portions of the rod to provide a positive force downward on the rod in an attempt to assure contact along the width of the web. The latter type of metering rod is commonly referred to as a Meier rod.

One of the problems associated with the use of a Meier rod, or for that matter any metering rod, is that the amount of coating metered by the rod and applied to the web is dependent on the tension on the ends of the web or, equivalently, the net downward force of the web on the rod. If the force is not uniform across the web, there will be an uneven coating thickness across the web width from edge to edge because the rod will meter more coating off the web at the taut spots than at the loose spots. The result is a non-uniform coatweight, which is very undesirable in subsequent processing and use of the web.

Another problem is presented when the web has a slack area in it. A slack spot is one where the paper is puckered, blistered, or raised. The slack spot can be an actual rise or sag in the web and can be of considerable size. The difficulty of running a slack spot in a web over a metering rod is that an excess of coating will be applied to the web in the slack area and the rod will not meter it off. The result is a wet streak of coating on the web, which will result in rejected product, blocked and uneven rolls, poor roll quality, and machine downtime for idler roll cleanups.

The apparatus and method of the present invention is intended to provide a net loading on the rod uniformly and directly on the web, independent of web tension, which will alleviate the aforementioned problems.

Attempts have been made heretofore in the prior art to accomplish this objective. In U.S. Pat. Nos. 3,683,851 and 3,029,779 a metering rod has its support in contact with a pneumatically inflatable, flexible tube to apply pressure along the rod to cause it to uniformily contact the excess coated web. In U.S. Pat. No. 3,029,779 the tube is in contact with and beneath an intermediate support block, while in U.S. Pat. No. 3,683,851 the tube presses against a cantilevered arm carrying the support for the metering rod. Neither of these arrangements are entirely satisfactory because the pressure tube is not in direct downward contact with the metering rod along its entire length, but only is in contact upwardly with an intervening support, and thus any irregularities in the support surface upon which the tube bears and rotates results in non-uniform pressure being exerted along the length of the rod. In the case of a cantilevered support, as in U.S. Pat. No. 3,683,851, the pressure on the rod will increase the further the rod is from the fulcrum point, again resulting in non-uniform pressure along the rod length and defeating the purpose of the device.

The only attempt to make direct contact with a coating metering device to apply a uniform force to the device is illustrated in U.S. Pat. No. 3,722,465 wherein an inflatable, pneumatic tube impinges directly upon a planar doctor blade or scraper, but not a rod metering device. When used with a rod metering device the inflatable tube should contact the rod directly but the rod must be properly supported for rotation. Accordingly, the arrangement of a doctor blade and pneumatic pressurizing tube in direct contact therewith on the coated side of the web as suggested in U.S. Pat. No. 3,722,465 could not find application in the combination of a rod metering device and pressurizing tube as the rod support would be inadequate, unless there is an intervening support member as in U.S. Pat. No. 3,029,779, to support the rod and permit its rotation.

SUMMARY OF THE INVENTION

Therefore, it is the general object of this invention to provide a device and a method of metering a uniformly thick coating on a continuously moving web using a rotating rod associated with a pneumatically pressurized tube on top of the rod to control the thickness and uniformity of the coating.

In accordance with the invention, a method and apparatus are provided for metering the coating on the coated side of a continuously moving web of material, such as paper, paperboard, linerboard, film, foil or the like, comprising a rod extending transversely of and in contact with the coating on the coated side of the web, and an expansible pressure tube extending across the uncoated side of the web, with provisions for supporting the tube including a channel member containing the tube and proportioned and arranged to inhibit rotation thereof. A protective skirt of relatively thin, flexible plastic sheet material is secured to the channel member, extends across the full width of the web, and has a free end portion disposed directly opposite the rod and extending in contact with and parallel to and in the direction of movement of the web intermediate the tube and web. Upon expansion, the tube cooperates with the skirt and rod to create a constant pressure web coating region between the web and the rod within which the coating thickness on the web is skimmed down by the rod to provide a smooth layer of coating of substantially uniform thickness essentially free of streaking even though the web may contain slack areas upstream of the rod or taut or loose spots across the width of the web.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
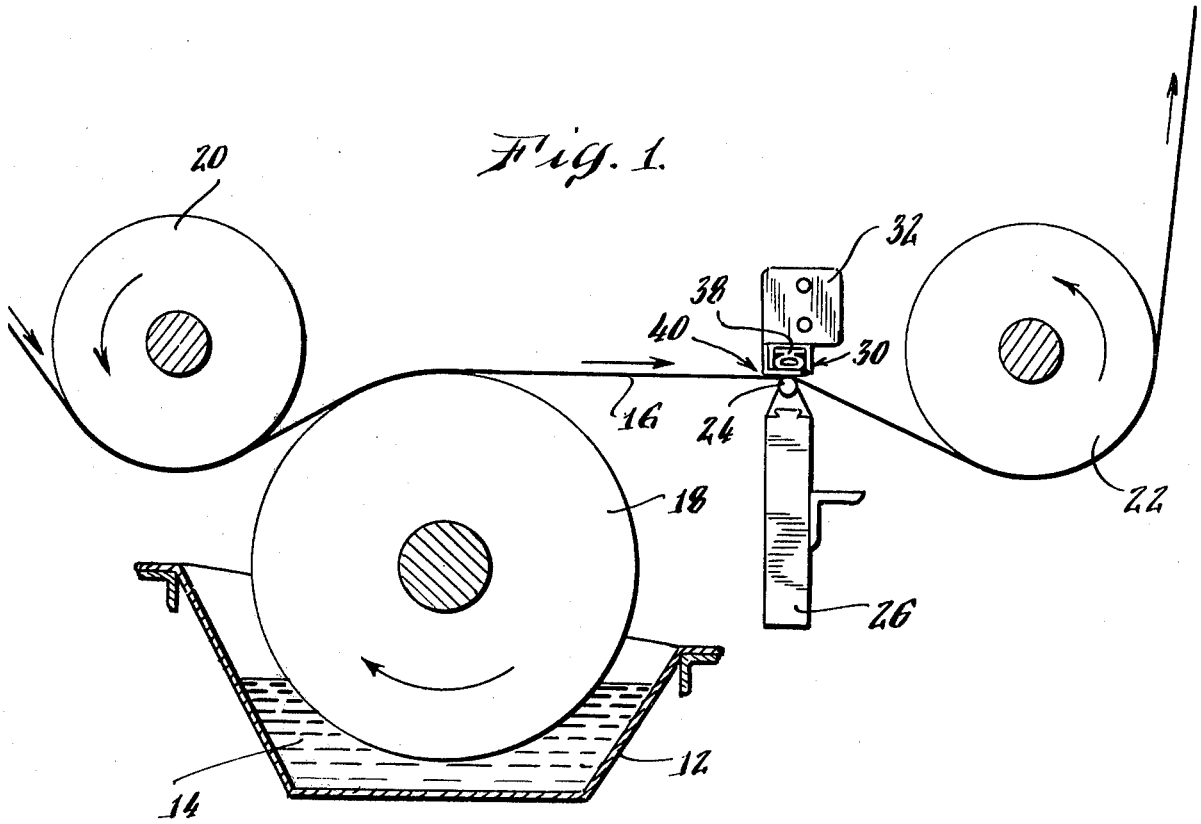
FIG. 1 is a schematic side view in elevation of the metering apparatus of the present invention applied to apparatus for coating a moving web, which also illustrates the method of the present invention.
Figure 2:
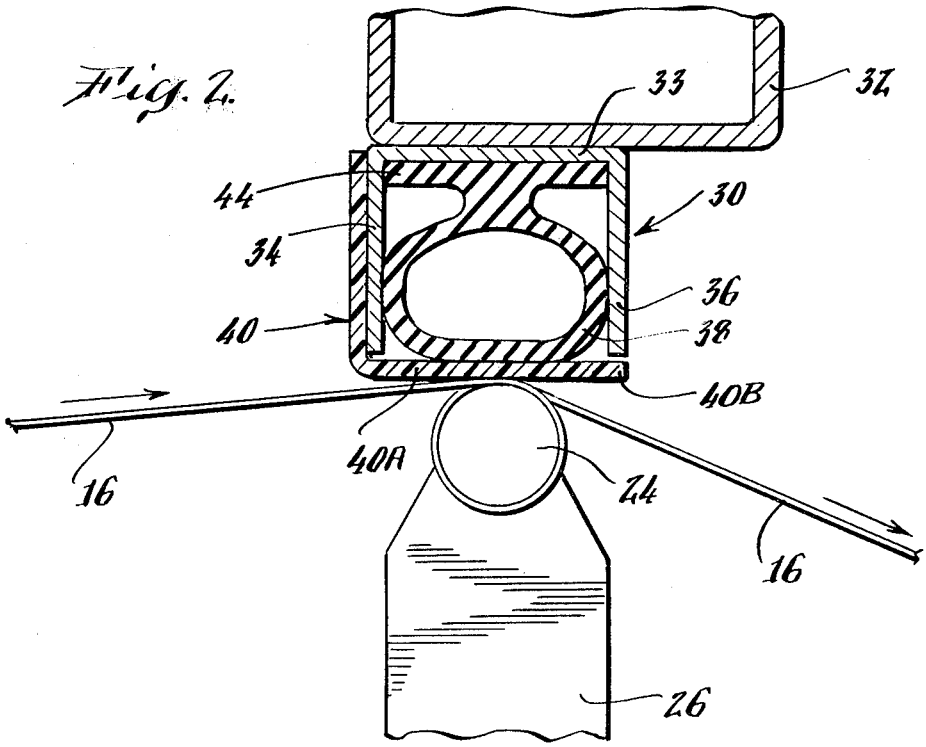
FIG. 2 is an enlarged fragmentary view, partly in section, of a portion of the apparatus illustrated in FIG. 1.

Referring now to the drawing in detail, wherein like numerals indicate like elements throughout the several views, the coating apparatus which is illustrated includes a coating pan 12 containing a quantity of liquid material 14 adapted to be applied to the underneath side of a moving web 16 by a roll applicator 18 partially immersed in the liquid coating material 14 in pan 12. Idler rollers 20 and 22 are disposed on opposite sides of roll 18 to direct the course of the moving web over roll 18 and through the coating metering device.

In order to meter and smooth the coating material 14 applied to the underside of the web 16, a Meier rod 24 rotatably mounted on top of a support 26 is adapted to contact the web 16 and coating material 14 to regulate the thickness of and smooth the coating material 14 to leave a uniform layer of coating material 14 on web 16. The web is usually wrapped around rod 24.

To assure that the coating material 14 is applied uniformly along the width of web 16, an oval-shaped, pneumatically pressurized tube 38 is placed in spaced relation directly above the top of and in alignment with the rod 24 at a distance therefrom sufficient to permit the web 16 and applied coating 14 to be threaded therethrough. In accordance with the invention, a thin plastic sheet or protective skirt 40 is interposed between the web 16 and tube 38 to protect the tube against abrasion from the upper surface of web 16.

Tube 38 is housed within the legs 34 and 36 of an inverted U-shaped channel member 30 fixed to a rectangular beam support 32. Protective skirt 40 is fixed to leg 34 of inverted channel member 30, while tube 38 is formed from rubber or a similar elastomer material and has a flange 44 secured by adhesive to the interior surface of web 33 of channel member 30. Tube 38 extends along most of the length of channel member 30 and over the entire width of web 16, and has one end closed and its opposite end connected for supply of air through a regulator set to limit the air pressure to a predetermined maximum to prevent tube 38 from rupturing. Channel member 30 and tube 38 are so proportioned and arranged as to inhibit rotation of tube 38 when it is inflated.

Skirt 40 can also be secured to a wall of beam 32 as well as by adhesive to the exterior of leg 34 of channel member 30 and has a horizontal free end portion **40*a* extending across the entire width of web 16 and cooperating with tube 38 and rod 24 to meter the coating on web 16. Free end portion 40*a* extends contiguous and parallel to and in the direction of movement of web 16 and in contact with a flat side of tube 38 intermediate the tube 38 and web 16. Upon expansion, tube 38 causes free end portion 40*a* of the skirt 40 to exert uniform constant pressure on web 16, and directly down onto the top of the rotating rod 34. As the web 16 passes through the nip of rod 24 and skirt portion 40*a*, the coating thickness applied by roll 18 to the underside of web 16 is skimmed down by rod 24** to the desired uniform coating thickness and excess coating composition removed by the metering device drops back into a suitable collection receptable (not shown).

Preferably, free end portion **40*a* of skirt 40 should have its upper face coated with an adhesive so that it will adhere to the entire flat, bottom surface of tube 38, so that uniform pressure is applied along the width of skirt portion 40*a*. Also, the transverse or trailing edge 40*b* of free end portion 40*a* should be completely beneath tube 38 when it is expanded to hold down free end portion 40*a* and to prevent tube 38 from contacting, and thereby becoming abraded by, web 16**.

By the way of example, and not of limitation, tube 38 is made of neoprene rubber and has a $\frac{5}{8}''$ (1.59 cm) wide base, 7/16" (1.11 cm) unexpanded height, 11/16" (1.75 cm) maximum expanded height, and a length 4" (10.6 cm) greater than the width of web 33. Channel member 30 is 1" (2.54 cm) by $\frac{1}{2}''$ (1.27 cm) by $\frac{1}{8}''$ (0.32 cm) and of a length suitable to accomodate tube 38. Skirt 40 is made of ultra high molecular weight polyethylene 0.010" (0.254 mm) to 0.015" (0.381 mm) in caliper and 2" (5.08 cm) wide with adhesive backing on the surface facing tube 38. Rod coater 24 may be of the smooth, wire wound, or machined type, is made of stainles steel and has a $\frac{1}{4}''$ (0.635 cm) diameter and a length 4" (10.16 cm) greater than the width of web 33.

In operation, tube 38 is inflated to a pressure of about 10 psi. (0.703 kg per sq. cm). The web 33, carrying a water-based coating material on its lower surface, is passed between and in contact with rod coater 24 and the free end portion **40*a* of skirt 40. Upon expansion, tube 38 cooperates with rod coater 24, web 16 and the free end portion 40*a* of skirt 40 to create a constant pressure web coating region between web 16 and rod coater 24** within which the coating thickness is skimmed down to provide a smooth layer of coating of substantially uniform thickness essentially devoid of streaks.

What is claimed is:

1. Apparatus for metering and smoothing a coating on the coated side of a moving web of material comprising:

a rod for metering and smoothing the coating extending across the web and in contact with the coating, an expansible pressure tube extending across and contiguous to the uncoated side of the web, disposed in alignment with and directly opposite the rod, and adapted to exert a uniform pressure on the rod and the portion of the web contiguous to the rod, and a skirt of paper-thin, flexible plastic material extending across the web and having a portion disposed intermediate and in conforming contact with the tube and web and extending in the direction of movement of the web, the tube upon expansion having part of its surface in contact with said skirt portion and cooperating with the web and said skirt portion and the rod to create a constant pressure web coating region between the web and the rod to provide a layer of coating on the web of substantially uniform thickness.

2. Apparatus in accordance with claim 1 including: means for supporting the tube, rod and skirt.

3. Apparatus in accordance with claim 2 wherein the tube, skirt and rod extend across the full width of the web, and said skirt portion is a free end portion.

4. Apparatus in accordance with claim 3 wherein the support means includes:

a channel member containing and secured to the tube, proportioned and arranged to prevent rotation to the tube, and having its outer surface attached to the skirt.

5. Apparatus in accordance with claim 4 including a horizontally arranged beam of rectangular cross-section, the channel member having the exterior side of its web secured to the bottom surface of the beam, the exterior side of one of its legs in vertical alignment with the exterior surface of one of the sides of the beam, and its legs extending vertically downward to a position contiguous to the moving web.

6. A method for metering and smoothing a coating on the coated side of a moving web of material comprising:

feeding the web between a skirt of flexible sheet material and a rod for metering and smoothing the coating, the rod being disposed in rolling contact with the coating, the skirt extending across the web and having a portion extending in contact with and in the direction of movement of the uncoated side of the web, and creating a constant pressure web coating region across the web between the web and the rod by inflating an expansible tube along said skirt portion to cause said skirt portion to bear on the uncoated side of the web and on the rod to provide a layer of skimmed coating on the web of substantially uniform thickness.

7. A method for metering a coating in accordance with claim 6, in which the tube, skirt and rod extend across the full width of the web, and said portion of the skirt is a free end portion.

* * * * *